United States Patent [19]

Zollner

[11] Patent Number: 4,983,236

[45] Date of Patent: Jan. 8, 1991

[54] PROCESS AND DEVICE FOR MACHINE APPLICATION OF SEALING GLANDS TO ELECTRIC LINES

[75] Inventor: Manfred Zollner, Waltrop, Fed. Rep. of Germany

[73] Assignee: Grote & Hartmann GmbH & Co. KG, Fed. Rep. of Germany

[21] Appl. No.: 378,716

[22] Filed: Jul. 12, 1989

[30] Foreign Application Priority Data

Jul. 13, 1988 [DE] Fed. Rep. of Germany ..... 3823720

[51] Int. Cl.[5] ..... H01B 13/06

[52] U.S. Cl. ..... 156/52; 156/294; 156/423; 174/65 SS; 174/74 A; 174/93

[58] Field of Search ..... 29/857; 156/51, 52, 156/294, 423; 174/65 SS, 65 G, 74 A, 93

[56] References Cited

FOREIGN PATENT DOCUMENTS 87067536 5/1987 Fed. Rep. of Germany .

*Primary Examiner*—Robert A. Dawson

*Attorney, Agent, or Firm*—Jones, Askew & Lunsford

[57] ABSTRACT

A process and apparatus for applying sealing glands to electric lines. The sealing glands are positioned in guide sleeve, and the electric line is held by centering jaws so that the electric line and the sealing gland are in alignment with each other. Clamping jaws secure the electric line a short distance behind the end of the line, which is secured with very little play in the centering jaws. A ram is inserted into the guide sleeve, and moves the guide sleeve and the sealing gland toward the electric line until the sealing gland strikes the centering jaws. The centering jaw mechanism then moves toward the clamping jaw mechanism, and the sealing gland is pushed over the electric line.

22 Claims, 2 Drawing Sheets

FIG. 1a
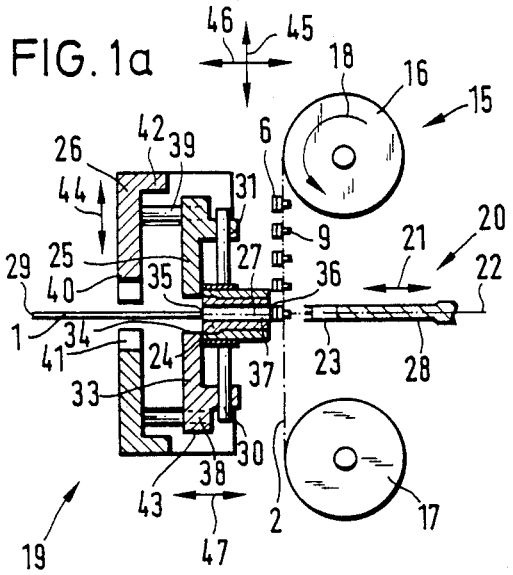
FIG. 1b
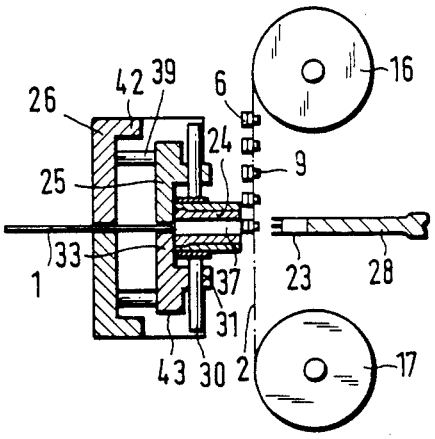
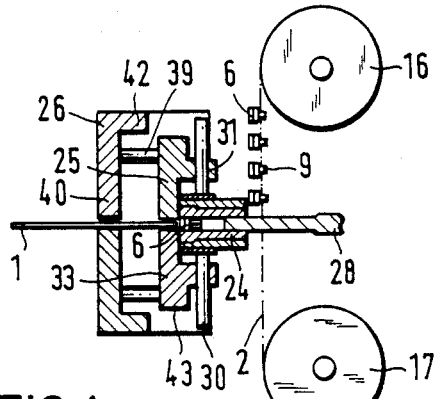
FIG. 1c
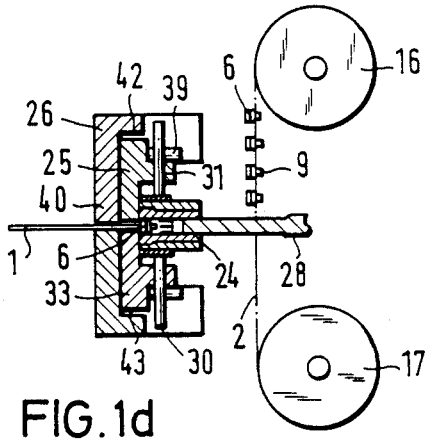
FIG. 1d
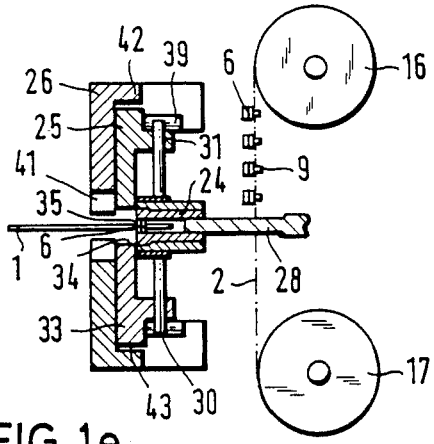
FIG. 1e
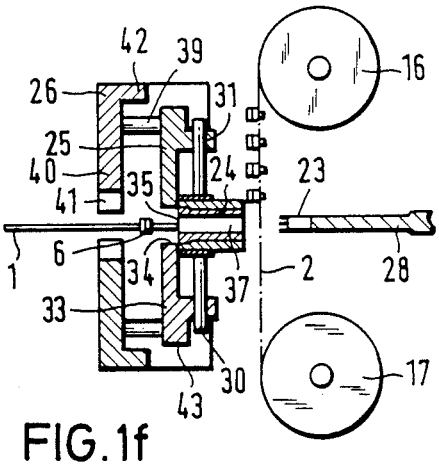
FIG. 1f

PROCESS AND DEVICE FOR MACHINE APPLICATION OF SEALING GLANDS TO ELECTRIC LINES

This invention concerns a process and a device for machine application of sealing glands made of an elastic material, e.g., rubber or plastic, to an electric line for plug designs, etc., that are protected from water.

It is known that a sealing gland can be slipped on an electric line before crimping an electric connector. Such a sealing gland should seal off slits between an opening or a passage in a housing wall and the crimped electric line inserted into the housing to prevent leakage of water. Such a gland has an axial cylindrical passage for the electric line. As a rule, the outer contour has a cylindrical area for crimping the corresponding prongs of an electric connector and sealing ribs connected to it in the form of a ring web.

A sealing gland is applied by first pushing the gland over the free end of an electric line and then stripping the free end of the electric line and next crimping an electric connector onto the stripped end, so the prongs of the connector provided for this purpose are pushed around the cylindrical area of the sealing gland. Thus, the gland is secured on the electric line.

It is important for the gland to be a certain distance away from the end of the electric line and to be completely centered on the line, so positioning of the crimped element consisting of the line and the gland in a housing can also be performed by machine so the electric connector assumes its precise position in the housing and the sealing gland fits exactly so as to form a seal.

According to a known process that operates with a machine, the sealing glands are placed on a carrier belt, e.g., by gluing, and the belt is fed into an assembly machine where a ram pushes a sealing gland from the carrier belt onto an electric line, whereupon the electric line fitted with the sealing gland is insulated and crimped with an electric connector. The known process operates too slowly. Furthermore, numerous components and control devices are needed, but they cannot operate very rapidly. In particular, the positioning of the end of the line and the handling of very thin flexible electric lines pose problems because the line and the end of the line have a tendency to bend. Therefore, extremely flexible lines cannot be fitted with a sealing gland with the known equipment.

According to a proposal by the present applicant, sealing glands are applied with a very high accuracy to electric lines in a process that is much more rapid and operates without any great expense. It is thus even possible to fit flexible lines with sealing glands.

According to an older proposal disclosed in German Utility Model No. G8706 753.6 by the present applicant, the sealing gland is pushed onto the end of an electric line by being shot with a surge of air pressure so the sealing gland preferably flies a short free distance between the mouth of the shooting device and the free end of the electric line.

According to a particular version of the older proposal, the free end of flexible lines in particular is made rigid by supercooling before shooting the sealing gland onto it. For example, the end of the electric line may be blown, sprayed or otherwise briefly exposed to liquid nitrogen.

The process and apparatus according to the older proposal have proven successful.

The purpose of the present invention is to create a process that works without compressed air as well as a simple device for mechanical application of sealing glands to electric lines to permit centering of the end of the line such that the sealing gland can be easily pushed onto the end of an electric line without the use of mechanical means.

On the basis of the example illustrated in the figures, this invention will now be explained in greater detail below. The figures show the following.

FIGS. 1*a*–1*f* show schematic side views of the apparatus as well as its operation.

Figure 2:
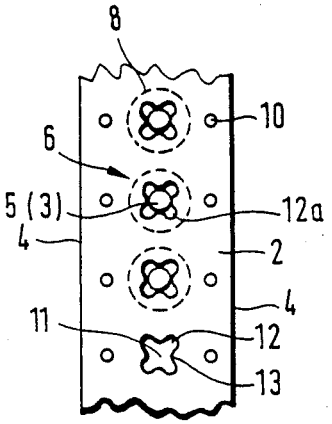
FIG. 2 shows a top view of the sealing gland carrier belt.
Figure 3:
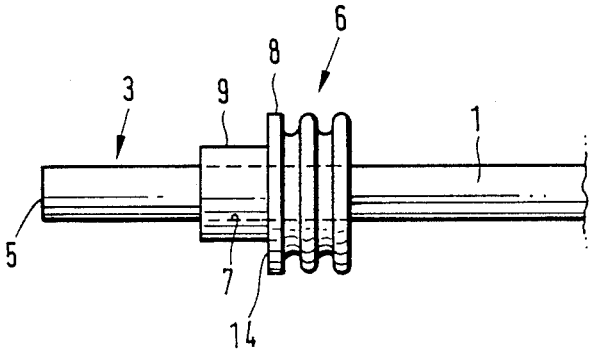
FIG. 3 shows a side view of an electric line with a sealing gland.

The sealing gland (6) is cylindrical and has a central cylindrical passage (7) in which line (1) is inserted in a form fitting manner, so the free end (3) of electric line (1) projects a certain distance beyond the end of the sealing gland. Ring webs (8) are arranged some distance apart in the area of sealing gland (6) facing away from end (5) of line (1). As is already known, these ring webs (8) are provided to fulfill a sealing function between a housing wall (not shown) and line (1). Toward the end (5) of line (1) sealing gland (6) has a cylindrical area (9) around which the prongs of an electric connector (not shown) are to be crimped, so the sealing gland (6) will sit tightly on line (1).

Several sealing glands (6) are stored together in a carrier belt (2).

The sealing gland carrier belt (2) is made of plastic, e.g., Mylar, and has transport holes (10) in the area of the side edges (4), as is known already, and these transport holes serve to engage transport fingers (not shown). Bearing holes (11) are punched out in a row with some distance between them in the middle of carrier belt (2) longitudinally. Bearing holes (11) have semicircular corner areas (12) with projections (13) provided between two corner areas (12). Cylindrical areas (9) of sealing glands (6) are inserted into bearing holes (11), which is why end face (5) of cylindrical area (9) of the sealing glands (6) can be seen in FIG. 2 and the ring webs (8) of sealing glands (6) are shown with a dotted line because they are on the other side of carrier belt (2). Cylindrical areas (9) are clamped in place by projections (13). Carrier belt (2) is in contact with the outside face (14) of the first ring web (8) Corner areas (12) form free access passages (12*a*) to the face (14) of the first ring web (8) of sealing gland (6) which is in contact with carrier belt (2). The purpose of the free access passages (12*a*) will be explained below.

Carrier belt (2), which stores the individual line packings or sealing glands (6) in the form of a magazine, is rolled up onto a reel mechanism (15) which has transport rolls (16, 17) arranged so they are aligned but are some distance apart and at least one of them can be driven incrementally by means of an appropriate drive mechanism (not shown), so rolls (16, 17) rotate in the direction of arrow (18) and carrier belt (2) is unwound from roll (16) onto roll (17). Carrier belt (2) is arranged in the area of an assembly mechanism (19) such that the ring webs (8) face the assembly mechanism (19) and the cylindrical areas (9) of the sealing gland (6) face the ram mechanism (20).

The ram mechanism (20) has a ram (28) that can move back and forth in the direction of double arrow (21) and has fingers (23) that run parallel to axis (22) and are arranged either so they are distributed at equal distances in a circle on the free end of the ram or in the corners of a rectangle. Fingers (23) are of such dimensions that they pass through the free access passages (12*a*) of the carrier belt (2) and reach the face (14) of sealing gland (6) so they can press sealing gland (6) out of carrier belt (2).

The assembly mechanism (19) which constitutes the main component of this device has essentially a guide sleeve (24), a centering device (25) with jaws and a device (26) with clamping jaws.

Guide sleeve (24) is arranged in such a way that longitudinal middle axis (27) is aligned with the axis (22) of ram (28). The longitudinal middle axis (27) of guide sleeve (24) is also aligned with longitudinal axis (29) of line segment (1) which is supplied to the assembly mechanism (19).

Guide sleeve (24) has two slip pins (30) mounted on the outer cylindrical surface of guide sleeves (24), so they extend radially outward and opposite each other. Pins (30) sit so they can slide in guide sleeves (31), which are in turn mounted in jibs (32) which run parallel with guide sleeve (24) from the centering jaws (33) of the jaw-type centering device (25) Running parallel with pins (30) the centering jaws (33) are positioned in such a way that their centering faces (34) are directly in front of the line plug opening (35) of guide sleeve (24). A sealing gland (6) is transported to a position in front of sealing gland plug opening (36) of guide sleeve (24) which is opposite line plug opening (35) and then the sealing gland can be pushed into the guide channel (37) of guide sleeve (24) by means of the ram fingers (23).

In the jaw-type centering device (25) bearing bushes (38) which are held by slip pins (39) so they can slide and are parallel to guide sleeve (24) sit in the end area of centering jaws (33) that faces away from guide faces (34). Slip pins (39) are mounted on the clamping jaw mechanism (26).

Clamping jaw mechanism (26) has clamping jaws (40) that run parallel to centering jaws (33) and are equipped with clamping webs (41) on the free end. On the other end of clamping jaws (40) there is a guide jib (42) that runs parallel to the axes (22, 27, 29) and can slide on the free end faces (43) of the centering jaw mechanism (25) where it is supported.

The drive mechanism, which is not shown here, for the assembly mechanism (19) is designed so that clamping jaws (40) can move in the direction of double arrow (44), while centering jaws (33) can move in the direction of double arrows (45, 46) and guide sleeve (24) can move in the direction of double arrow (47). These movements of the essential parts of the assembly mechanism result in an operation as documented in FIGS. 1*a* to 1*f*.

According to FIG. 1*a*, line (1), the individual line seal or sealing gland (6) and ram (28) are aligned.

The clamping jaws (40) and centering jaws (33) are open.

Line (1) is clamped by clamping jaws (40). In doing so, centering jaws (33) hold line (1). Line (1) has a play of about 1/10 mm in centering jaws (33). Clamping jaws (40) which are connected to centering jaws (33) are automatically adjusted to any line diameter that is to be processed (FIG. 1*b*).

As FIG. 1*c* shows, ram (28) takes the individual line seal or sealing gland (6) from one side and is then inserted into the guide sleeve (24) until sealing gland (6) strikes centering jaws (33). Centering jaws (33) thus project in front of line plug opening (35).

Ram (28) is connected to the centering jaw mechanism (25) in such a way that the centering jaw mechanism moves toward the clamping jaw mechanism (26) and the individual line seal or sealing gland (6) is pushed over line (1) in synchronization with this movement. Since the diameter of ram (28) corresponds to the inside diameter of guide sleeve (24), i.e., it fits in a form fitting manner into the guide sleeve, this results in a centered guidance of sealing gland (6) (FIG. 1*d*).

After the individual line seal has been pushed onto line (1), the clamping and centering jaws open (FIG. 1*e*).

The ram returns to the starting position with the centering jaw mechanism and the guide sleeve (FIG. 1*f*).

According to this invention, sealing gland (6) is pushed onto the end of the line without first stripping the end of the line. This offers the advantage that no damage is done to the stripped end of the line.

Fingers (23) of ram (28) are so long that a hollow space is formed between the fingers and/or in ram (28), so it can receive line area (3) of line (1). Sealing gland (6) is guided in a form fitting manner during assembly. It is thus possible with simple means to assure precise positioning of sealing gland (6) on line (1), and secure guidance of the line and the sealing gland is possible.

I claim:

1. Process for machine application of sealing glands to electric lines, where the sealing gland is held in a guide sleeve during application and the line is secured by centering jaws, characterized in that the line and a sealing gland are arranged in alignment, and clamping jaws secure the line some distance behind the end of the line which is held with little play in the centering jaws, the sealing gland is positioned directly in front of the end of the line in a guide sleeve and is secured in the guide sleeve, whereupon the guide sleeve and thus the sealing gland together with the centering jaws are moved in the direction of the clamping jaws so the sealing gland is pushed onto the line.

2. Process according to claim 1 characterized in that a ram pushes the sealing gland into the passage of the guide sleeve up to the opening and secures the sealing gland there until it has been pushed into its final position.

3. Process according to claim 1 or 2 characterized in that the line of the sealing gland and the ram are brought into alignment before pushing the sealing gland onto the line and before the clamping jaws and the centering jaws close.

4. Process according to claims 1 or 2 characterized in that the line is secured in the centering jaws with a play of 1/10 mm.

5. Process according to claim 1 characterized in that the sealing gland is pushed by the ram from the carrier belt into the passage of the guide sleeve.

6. Process according to claim 5 characterized in that the sealing gland is pushed toward the centering jaws.

7. Process according to claim 1 characterized in that the centering jaws are moved together with the ram and the guide sleeve in the direction of the clamping jaws and in doing so the sealing gland is pushed onto the line in synchronization with this movement.

8. Process according to claim 1 characterized in that the centering jaws and the clamping jaws move apart simultaneously after the sealing gland has been pushed onto the line and thereby release the line, and then the centering jaws together with the guide sleeve and the ram return to their starting positions.

9. Apparatus for machine application of sealing glands to electric lines whereby the sealing glands are held in a guide sleeve during application and the line is secured by centering jaws, especially for carrying out the process according to claim 1, characterized in that the guide sleeve (24) sits on a centering jaw mechanism (25) which is combined with a clamping jaw mechanism (26).

10. Apparatus according to claim 9 characterized in that the guide sleeve (24) has two slip pins (30) which are mounted on the outer cylindrical surface of the guide sleeve and extend to slide in guide sleeves (31), which are in turn mounted in jibs (32) which extend parallel to the guide sleeve (24) from centering jaws (33) of the centering jaw mechanism (25), and the centering jaws (33) running parallel to pins (30) are positioned such that their centering faces (34) are positioned directly in front of a line plug opening (35) of guide sleeve (24).

11. Apparatus according to claim 9 characterized in that bearing bushes (38) that run parallel to guide sleeve (24) are provided in the end area of centering jaws (33) facing away from guide faces (34) in centering jaw mechanism (25), and slip pins (39) that are attached to the clamping jaw mechanism (26) slip into these bearing bushes and hold them.

12. Apparatus according to claim 9 characterized in that the clamping jaw mechanism (26) has clamping jaws (40) that run parallel to centering jaws (33) and are equipped with clamping webs (41) on the free end.

13. Apparatus according to claim 12 characterized in that a guide jib (42) that runs parallel to guide sleeve (24) is provided on the other end of clamping jaws (40) and can glide so it is supported on the free ends (43) of the centering jaw mechanism (25).

14. Apparatus according to claim 9 characterized in that a ram mechanism (20) is provided in front of a sealing gland plug opening (36) of guide sleeve (24) and has a ram (28) that can move back and forth in the direction of double arrow (21) and has fingers (23) that run parallel to the axis (22) of ram (28) and are arranged on the free end of the ram where they are positioned in a generally annular pattern.

15. Apparatus according to claim 14 characterized in that the outside diameter of ram (28) corresponds to the inside diameter of passage (37) in guide sleeve (24).

16. Apparatus according to claim 14 characterized by a carrier belt (2) that stores the sealing glands (6) in the form of a magazine where the carrier belt (2) is reeled by a reel mechanism (15) which has transport rolls (16, 17) arranged so they are aligned with some distance between them and at least one of these rolls can be driven incrementally by appropriate drive means, and carrier belt (2) is arranged in the area in front of the assembly mechanism (19) in such a way that a sealing gland (6) on carrier belt (2) can be pushed with the ram mechanism (20) into the passage or guide channel (37) of guide sleeve (4).

17. Apparatus according to claim 16 characterized in that the carrier belt (2) is made of plastic and has bearing holes (11) for the sealing glands (6) punched in a row one after the other with some distance between them in the longitudinal middle of the carrier belt (2).

18. Apparatus according to claim 17 characterized in that the bearing holes (11) have semicircular corner areas (12) with projections (13) between two corner areas (12), and cylindrical areas (9) of the known sealing glands (6) are inserted into the bearing holes, where said cylindrical areas (9) are secured by the clamping projections (13), and carrier belt (12) is in contact with the outside face (14) of the first ring web (8) of sealing gland (6), and the corner areas (12) have free access passages (12*a*) to the face (14) of the first ring web (8) of sealing gland (6) next to the carrier belt (2).

19. Apparatus according to claim 18 characterized in that the fingers (23) of ram (28) are of such dimensions that they are inserted through the free access passages (12*a*) of the carrier belt (2) and reach the face (14) of sealing gland (6) and can push a sealing gland (6) out of carrier belt (2).

20. Apparatus according to claim 14 characterized in that the guide sleeve (24) is arranged in such a way that its longitudinal middle axis (27) is aligned with the axis (22) of ram (28) and with the longitudinal axis (29) of line segment (1) which is fed to an assembly mechanism (19).

21. Apparatus according to claim 20 characterized in that the assembly mechanism (19) is driven in such a way that the clamping jaws (40) can move in the direction of double arrow (44), centering jaws (33) can move in the direction of double arrows (45, 46) and guide sleeve (24) can move in the direction of double arrow (47).

22. Apparatus according to claim 20 characterized in that the carrier belt (2) is arranged in the area in front of the assembly mechanism (19) in such a way that ring webs (8) face the assembly mechanism (19) and the cylindrical areas (9) of sealing gland (6) face the ram mechanism (20).

* * * * *